US008961215B2

(12) United States Patent
Hasegawa

(10) Patent No.: US 8,961,215 B2
(45) Date of Patent: Feb. 24, 2015

(54) ELECTRICAL CONNECTOR ASSEMBLED COMPONENT, PLUG CONNECTOR, AND RECEPTACLE CONNECTOR

(71) Applicant: Hirose Electric Co., Ltd., Tokyo (JP)

(72) Inventor: Yohei Hasegawa, Tokyo (JP)

(73) Assignee: Hirose Electric Co., Ltd., Tokyo (JP)

( * ) Notice: Subject to any disclaimer, the term of this patent is extended or adjusted under 35 U.S.C. 154(b) by 115 days.

(21) Appl. No.: 13/873,419

(22) Filed: Apr. 30, 2013

(65) Prior Publication Data

US 2013/0295784 A1 Nov. 7, 2013

(30) Foreign Application Priority Data

May 1, 2012 (JP) ..... 2012-104787

(51) Int. Cl.

| | |
|---|---|
| ***H01R 13/62*** | (2006.01) |
| ***H01R 13/11*** | (2006.01) |
| ***H01R 12/71*** | (2011.01) |
| ***H01R 12/73*** | (2011.01) |
| ***H01R 12/00*** | (2006.01) |

(52) U.S. Cl.

CPC ..... *H01R 9/091* (2013.01); *H01R 13/11* (2013.01); *H01R 12/716* (2013.01); *H01R 12/73* (2013.01)

USPC ..... 439/346; 439/74

(58) Field of Classification Search

USPC ..... 439/346, 74

See application file for complete search history.

(56) References Cited

U.S. PATENT DOCUMENTS

| | | | | |
|---|---|---|---|---|
| 4,971,571 | A * | 11/1990 | Puerner | 439/346 |
| 5,224,866 | A * | 7/1993 | Nakamura et al. | 439/81 |
| 5,310,357 | A * | 5/1994 | Olson | 439/346 |
| 5,931,689 | A * | 8/1999 | Patel | 439/346 |
| 6,846,187 | B2 * | 1/2005 | Yu | 439/74 |
| 7,758,352 | B2 * | 7/2010 | Zeng | 439/74 |

FOREIGN PATENT DOCUMENTS

JP 2010-198996 A 9/2010

* cited by examiner

*Primary Examiner* — Gary Paumen

(74) *Attorney, Agent, or Firm* — Kubotera & Associates, LLC

(57) ABSTRACT

An electrical connector assembled component includes a plug connector and a receptacle connector. The receptacle connector includes a plurality of mating terminals having receptacle contact portions and a receptacle housing. The plug connector includes a plurality of terminals having plug contact portions and a plug housing. The plug housing includes a fitting portion. The terminals include an edge terminal disposed on one end portion of the fitting portion. The edge terminal includes a plug side plate portion, a plug edge plate portion, and a locking portion. The mating terminals include an edge mating terminal disposed on one end portion of the receptacle housing. The edge mating terminal includes a receptacle side plate portion, a receptacle edge plate portion, and a locked portion formed on the receptacle edge plate portion for engaging with the locking portion.

8 Claims, 6 Drawing Sheets

ELECTRICAL CONNECTOR ASSEMBLED COMPONENT, PLUG CONNECTOR, AND RECEPTACLE CONNECTOR

BACKGROUND TECHNOLOGY AND RELATED TECHNOLOGY

The present invention relates to an electrical connector assembled component having a plug connector to be disposed on a circuit board and a receptacle connector to be disposed on another circuit board and to be fitted and connected to the plug connector. Further, the present invention relates to the plug connector and the receptacle connector of the electrical connector assembled component.

Patent Reference has disclosed a conventional electrical connector assembled component. According to the conventional connector assembled component disclosed in Patent Reference, both a receptacle connector and a plug connector thereof have components (metal members). The component includes a connecting section for fixing the plug connector or the receptacle connector to a circuit board by soldering.

Further, when the receptacle connector is connected to the plug connector, the components engage (lock) with each other, so that the receptacle connector does not come off from the plug connector. In addition, the components also serve as power source terminals that are electrically connected at portions thereof locking with each other. The components are made from sheet metal and are held in a housing at both ends of each terminal of the connectors in the terminal arrangement direction.

Patent Reference Japanese Patent Publication No. 2010-198996

In the conventional connector assembled component disclosed in Patent Reference, the component of the receptacle connector has end sections supported with end walls of the housing and side sections that are formed being bent from the end sections and are supported by both side walls, and has a U-shape as a whole when viewed from the connector fitting direction. Each end portion has a hook-like engaging section that protrudes upward and is bent in an inverse U-shape, and each side portion is held by both inner surfaces of side walls of the housing by surface contact thereto and has a concave engaging section formed thereon.

On the other hand, the component of the plug connector has a flat member part, which is parallel to the end portion of the component of the receptacle connector, and has a protruding locking section that enters and engages with the concave engaging section at both ends thereof as sectional end surfaces taken along the plate thickness direction, and further includes a U-shape piece that is bent from a lower edge of the flat member part and extends upward, with another protruding locking section is provided on a plate surface thereof.

According to Patent Reference, the portions of the respective components, which lock each other, are referred to as differently so as to easily distinguish therebetween, i.e. a component of the receptacle connector is referred to as a "engaging section", and a securing section of the plug connector is referred to as a "locking section".

In the conventional connector assembled component disclosed in Patent Reference, once the plug connector fits and connects to the receptacle connector, which have components as described above, in the fitting process, the protruding locking section and another protruding locking section of the plug connector can proceed to specified positions for the fitting, while being in a state that the corresponding concave engaging section and inverse U-shaped hook-like engaging section are elastically deformed for the amount of the interference.

Once reaching the specified positions, the elastic deformations are released, and the corresponding locking sections and engaging sections engage each other for the amount of interference and thereby exhibit a locking effect to prevent the connectors' coming off therefrom. In addition, as described above, the both components also serve as power source terminals, and are configured to electrically connectable in at least one of the three locking sections.

In the conventional connector assembled component disclosed in Patent Reference, when the components are in the locked state, the locking sections of the components of the plug connector is positioned below the engaging sections of the receptacle connector, with the amount of interference to the engaging sections. Since the electrical connector assembled component does not specially has a configuration to energize to have the locking sections and the engaging sections contact to each other, in the locked state, the locking sections do not contact with the engaging sections of the receptacle and are positioned with a certain distance away therefrom in the connector insertion/removal direction, while being able to lock.

Even when the locking sections are positioned to be able to contact with the engaging sections in the connector insertion/removal direction, contact pressure between the locking section and the engaging section is small. Therefore, when the both components are used as power source terminals having the locking sections and the engaging sections as contact points therebetween, the components do not contact to each other or unstably contact as described above, so that it is not possible to secure electrical connection therebetween.

Furthermore, as already described above, since the locking sections and the engaging sections have the locking function, when unexpected external force is applied in the connector removal direction on the connector assembled component that are in a connector fitted state, the locking sections and the engaging sections engage each other with engaging force against such external force. Accordingly, receiving the engaging force, there is a concern of deformation of the locking sections and the engaging sections, and therefore the state of contact between the locking sections and the engaging sections may become unstable.

In other words, according to the components of Patent Reference, although it is possible to secure the function as a locking section, it is not possible to fully secure the function as a contact section.

In view of the above-described problems, an object of the invention is to provide an electrical connector assembled component, a plug connector, and a receptacle connector, in which terminals thereof can lock to each other with enough engaging force and stably contact with each other.

Further objects and advantages of the invention will be apparent from the following description of the invention.

SUMMARY OF THE INVENTION

In order to attain the objects described above, according to a first aspect of the present invention, an electrical connector assembled component is an electrical connector assembled component, which includes: a plug connector to be disposed on a mounting surface of a circuit board; and a receptacle connector as a mating connector to be disposed on a mounting surface of another circuit board and for fitting and connecting the plug connector thereto in a connector insertion/removal direction as a direction perpendicular to the mounting surface.

According to the first aspect of the present invention, the receptacle connector includes a plurality of mating terminals, on which corresponding contact sections that contact with contact sections of terminals of the plug connector in a connector fitted state are formed, and a receptacle housing that holds the mating terminals so as to arrange corresponding contact sections of the plurality of mating terminals in an arrangement direction as a direction horizontal to the mounting surface of the circuit board. The receptacle housing has two side walls that extend in an arrangement direction of the corresponding contact sections and two end walls that extend perpendicularly to the arrangement direction and join end sections of the side walls. The space surrounded by the side walls and the end walls is formed as a receiving space to receive the plug connector.

According to the first aspect of the present invention, the plug connector includes a plurality of terminals, and a plug housing that holds the terminals so as to arrange contact sections of the plurality of terminals in the same direction as the arrangement direction. The plug housing has a fitting section to insert in the receiving space of the receptacle housing, and in the fitting section, there are formed side surfaces that face the side walls of the receptacle housing in the connector fitted state and end surfaces that face the end walls of the receptacle housing.

According to the first aspect of the present invention, in the electrical connector assembled component, the plurality of terminals provided in the plug connector includes end section side terminals, which are provided at both ends in the same direction as an arrangement direction of the corresponding contact sections of the mating terminal and are held at end section sides of the fitting section of the plug housing. Each end section side terminal is formed as one member by bending sheet metal, and has plug side plate sections that extend along the side surfaces of the fitting section, and a plug end plate section that extends along an end surface of the fitting section. On a plate surface of each plug side plate section, there is formed a contact section, and on a plate surface of the plug end plate section, there is formed a step-like locking section.

According to the first aspect of the present invention, a plurality of mating terminals provided in the receptacle connector includes end-side mating terminals that are provided at both ends in the arrangement direction, and are held at the end section sides of the receptacle housing. Each end section-side mating terminal is formed as one member by bending sheet metal, and has a receptacle side plate section that extends along a side wall of the receptacle housing, and a receptacle end plate section that extends along an end wall of the receptacle housing. On a plate surface of the receptacle side plate section, there is formed a corresponding contact section that contacts with a contact section of an end section-side terminal of the plug connector, and on a plate surface of the receptacle end plate section, there is formed a step-like section to be locked that can lock to a locking section of the end section-side terminal of the plug connector in the connector insertion/removal direction.

According to the first aspect of the present invention, in the connector fitted state, the end section-side terminals of the plug connector and the end section-side mating terminals of the receptacle connector contact to each other between contact sections formed on plate surfaces of the plug side plate sections of the end section-side terminals and corresponding contact sections formed on plate surfaces of the receptacle side plate sections of the end section-side mating terminals, with contact pressure in the plate thickness directions of their side plate sections.

According to the first aspect of the present invention, when the locking sections of the plug end plate sections of the end section-side terminals and the sections to be locked of the receptacle end plate sections of the end section-side mating terminals engage each other are in positions so as to be able to engage in the connector insertion/removal direction, which are different positions from the side plate sections, and receive unexpected external force in the connector fitted state, the locking sections and the sections to be locked engage each other in the connector insertion/removal direction.

As described above, according to the first aspect of the present invention, since the locking sections and the sections to be locked separately have contact sections and corresponding contact sections, respectively, the contact section and the corresponding contact section do not have to have a locking function. More specifically, it is not necessary to provide step-like sections on the contact sections and the corresponding contact sections to engage in the connector insertion/removal direction. Therefore, even when the connector assembled component receives unexpected external force in the connector insertion/removal direction in the connector fitted state, the contact sections and the corresponding contact sections do not engage each other. As a result, the contact sections and the corresponding contact sections do not receive engaging force against the external force, so that it is possible to prevent the contact state thereof from being unstable.

According to a second aspect of the invention, in the end section-side terminals provided in the plug connector, both plug side plate sections provided along both side surfaces of the plug housing can join to the plug end plate sections provided along end surfaces of the plug housing. In the end section-side mating terminals provided in the receptacle connector, the receptacle side plate sections respectively provided along both side walls of the receptacle housing and the receptacle end plate sections provided along end walls of the receptacle housing can join to each other.

As described above, according to the second aspect of the present invention, when two side plate sections and end plate sections are joined in each of the plug connector and the receptacle connector, once the fitting section of the plug connector is inserted in the receiving space of the receptacle connector, the contact sections of the two plug side plate sections of end section-side terminals and the corresponding contact sections of the two receptacle side plate sections of the end section-side mating terminals contact to each other on the side wall sides of the housings of both connectors in plate thickness directions of those side plate sections. Therefore, the end section-side terminals are in a state of being tightly pressed in the plate thickness direction by the two corresponding contact sections provided on both sides of the end section-side mating terminals. As this result, the contact pressure between the contact sections and the corresponding contact sections increases and thereby it is possible to stabilize the contact state.

According to a third aspect of the invention, it is possible to configure at least one of the end section-side terminals provided in the plug connector and the end section-side mating terminals provided in the receptacle connector, such that a portion having the locking section or the section to be locked can elastically displace in the plate thickness direction of the plug end plate sections or the receptacle end plate sections.

As described above, according to the third aspect of the present invention, when a portion having the locking section or the section to be locked can elastically displace, in the connector fitted state, a potion having the locking section and a potion having the section to be locked elastically contact to each other with sufficient contact pressure in the plate thickness direction. Therefore, since the locking section and the section to be locked to each other in the connector insertion/removal direction with sufficient amount of interference, it is possible to securely lock between the locking section and the section to be locked.

According to a fourth aspect of the invention, it is possible to configure at least one of the end section-side terminals provided in the plug connector and the end section-side mating terminals provided in the receptacle connector so as to be able to elastically displace in the plate thickness directions of the plug side plate sections or the receptacle side plate sections.

As described above, according to the fourth aspect of the present invention, when a portion having the contact section or the corresponding contact section can elastically displace in the plate thickness direction, in the connector fitted state, the contact section and the corresponding contact section elastically contact to each other with sufficient contact pressure in the plate thickness directions, so that it is possible to more securely stabilize the state of contact between the contact sections and the corresponding contact sections.

According to a fifth aspect of the present invention, a plug connector is to be disposed on a mounting surface of a circuit board, which fits and connects to a receptacle connector that is a mating connector for disposing on a mounting surface of another circuit board, with a connector insertion/removal direction is perpendicular to the mounting surface. The plug connector includes a plurality of terminals having contact sections that contact with corresponding contact sections of mating terminals provided in the receptacle connector in the connector fitted state; and a plug housing to hold the terminals such that contact sections of the plurality of terminals are arranged, with the arrangement direction is a direction parallel to a mounting surface of the circuit board. The plug housing has a fitting section for inserting in the receiving space of the receptacle housing, and the fitting section has side surfaces that extend in the arrangement direction and end surfaces that extend perpendicularly to the arrangement direction.

According to the fifth aspect of the present invention, in the plug connector, the plurality of terminals provided in the plug connector have end section-side terminals that are provided at both ends in the arrangement direction and held on the end section sides of the fitting section of the plug housing. Each end section-side terminals is formed as one member by bending sheet metal, and has a plug side plate section that extends along a side surface of the fitting section and a plug end plate section that extends along an end surface of the fitting section. On a plate surface of the plug side plate section, there are formed a contact sections that contact with corresponding contact sections of the end section-side terminals provided in the receptacle connector corresponding to the end section-side terminals, and on a plate surface of the plug end plate section, there is formed a step-like locking sections that can engage to the end section-side mating terminal of the receptacle connector in the connector insertion/removal direction.

According to a sixth aspect of the present invention, a receptacle connector is to be disposed on a circuit board, and fits and connects to a plug connector arranged on a mounting surface of another circuit board, with the connector insertion/removal direction being a direction perpendicular to the mounting surface. The receptacle connector includes a plurality of mating terminals, on each of which a corresponding contact section contacts with a contact section of the plug connector in the connector fitted state; and a receptacle housing that holds the mating terminals so as to arrange corresponding contact sections of the plurality of mating terminals with the arrangement direction being a direction parallel to the mounting surface of the circuit board. The receptacle housing has two side walls that extend in the arrangement direction of the corresponding contact sections, and two end walls that extend perpendicularly to the arrangement direction and join end sections of the side walls. The space surrounded by the side walls and the end walls is formed as receiving space to receive the plug connector.

According to the sixth aspect of the present invention, in the receptacle connector, the plurality of mating terminals provided in the receptacle connector has the end section-side mating terminals that are provided on both ends in the arrangement direction and held on the end section sides of the receptacle housing. Each end section-side mating terminal is formed as one member by bending sheet metal, and has receptacle side plate sections that extend along side walls of the receptacle housing, and a receptacle end plate section that extends along an end wall of the receptacle housing. On a plate surface of the receptacle end plate section, there is formed a corresponding contact section that contacts with a contact section of an end section-side terminal provided in the plug connector, corresponding to the end section side mating terminals, and on a plate surface of the receptacle end plate section, there is formed a step-like section to be locked that can engage the end section-side terminal in the connector insertion/removal direction.

As described above, according to the invention, in the end section-side terminals of the plug connector and the end section-side mating terminals of the receptacle connector, the locking sections or the sections to be locked are provided separately from the contact sections or the corresponding contact sections. Therefore, while it is possible to lock them each other at the locking sections and the sections to be locked with sufficient locking force, the contact sections and the corresponding contact sections do not have to have locking function, and it is possible to secure stable contact state between the contact sections and the corresponding contact sections.

In addition, since the contact sections provided on the plug side plate section and the corresponding contact sections provided on the receptacle side plate section contact to each other in the plate thickness directions of those side plate sections with contact pressure, it is possible to more securely contact the contact sections and the corresponding contact sections to each other.

BRIEF DESCRIPTION OF THE DRAWINGS

FIGS. 1(A) and 1(B) are perspective views showing a plug connector and a receptacle connector of an electrical connector assembled component according to an embodiment of the invention, wherein FIG. 1(A) is a perspective view of the plug connector and the receptacle connector in a state before fitting, and FIG. 1(B) is a perspective view of the plug connector in FIG. 1(A) that is vertically flipped;

FIGS. 4(A) and 4(B) are sectional views showing the plug connector and the receptacle connector of the electrical connector assembled component according to the embodiment of the invention, taken along a surface perpendicular to an arrangement direction of contact sections of terminals at a position of signal terminals in the arrangement direction, wherein FIG. 4(A) is a sectional view showing a state before fitting the connectors and FIG. 4(B) is a sectional view showing a state after fitting the connectors;

FIGS. 5(A) and 5(B) are sectional views showing the plug connector and the receptacle connector of the electrical connector assembled component according to the embodiment of the invention, taken along a surface perpendicular to the arrangement direction of the contact sections of the terminals at a position of contact sections of power source terminals in the arrangement direction, wherein FIG. 5(A) is a sectional view showing a state before fitting the connectors and FIG. 5(B) is a sectional view showing a state after fitting the connectors; and FIGS. 6(A) and 6(B) are sectional views showing the plug connector and the receptacle connector of the electrical connector assembled component according to the embodiment of the invention, taken along a surface perpendicular to the connector width direction of the contact sections of the terminals at a position of locking sections of the power source terminals in the connector width direction, wherein FIG. 6(A) is a sectional view showing a state before fitting the connectors and FIG. 6(B) is a sectional view showing a state after fitting the connectors.

DETAILED DESCRIPTION OF THE PREFERRED EMBODIMENTS

Hereunder, referring to the accompanying drawings, embodiments of an electrical connector of the invention will be described.

Figure 1B:
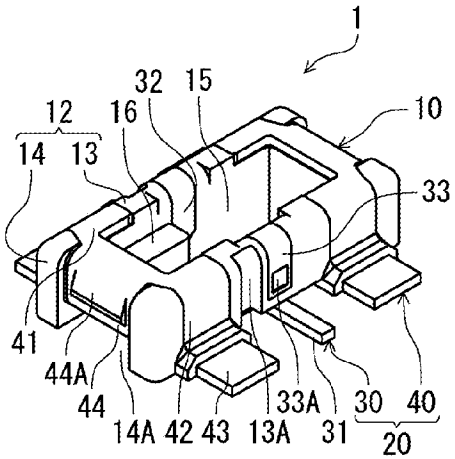
Figure 1A:
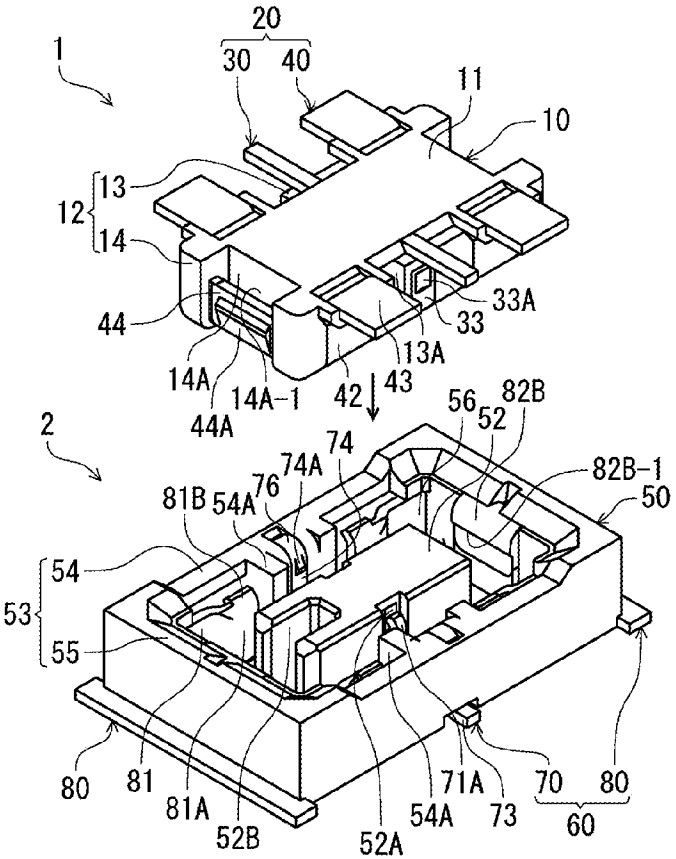
Figure 2:
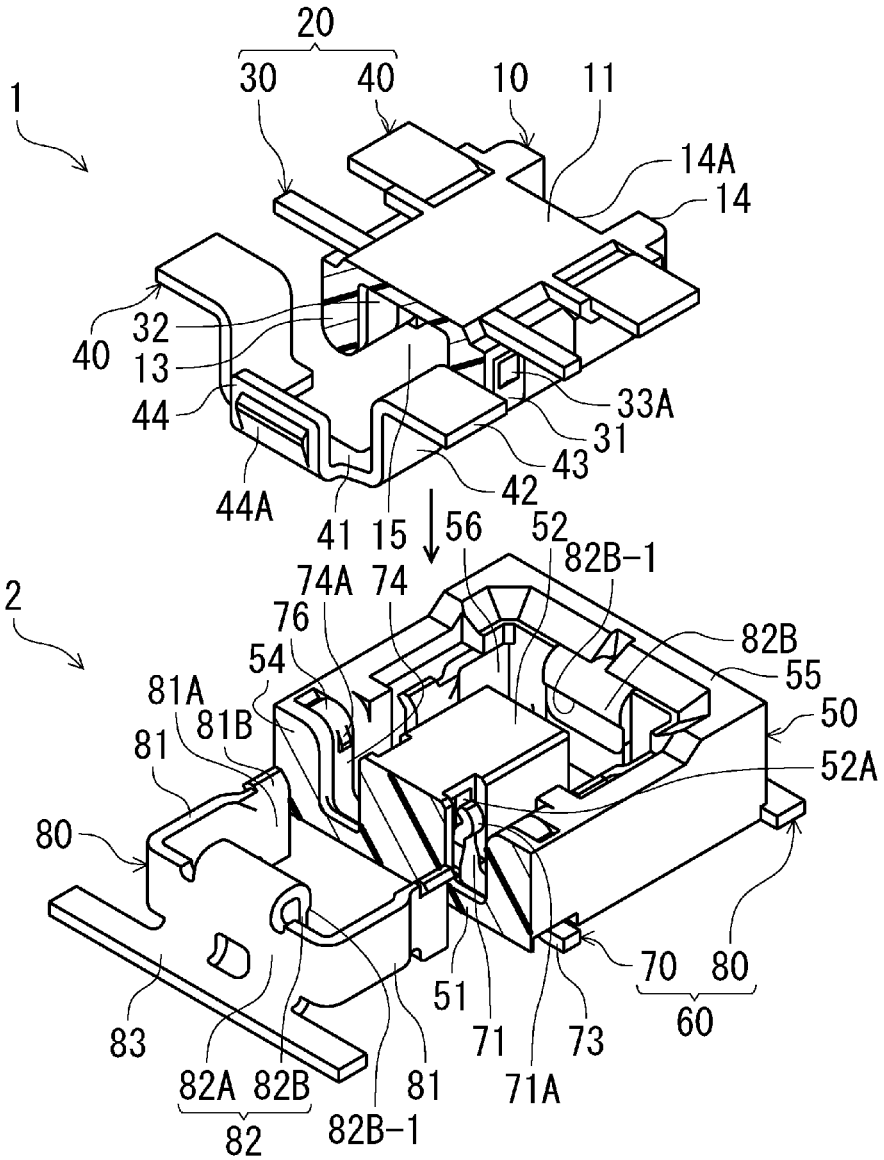
FIG. 2 is a partially cutaway perspective view of a plug housing of the plug connector and a receptacle housing of the receptacle connector of the electrical connector assembled component according to the embodiment of the invention.
Figure 3A:
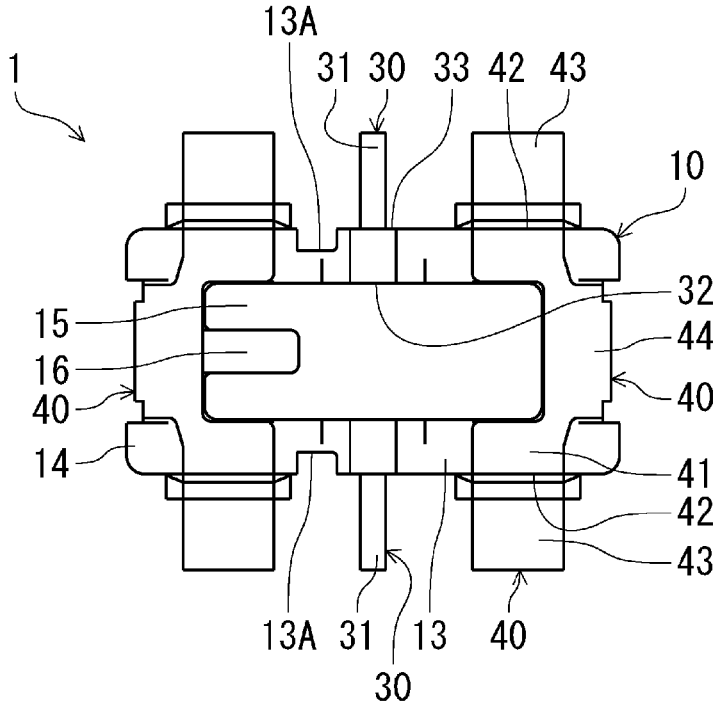
FIG. 3(A) is a bottom view of the plug connector of the electrical connector assembled component according to the embodiment of the invention.
Figure 3B:
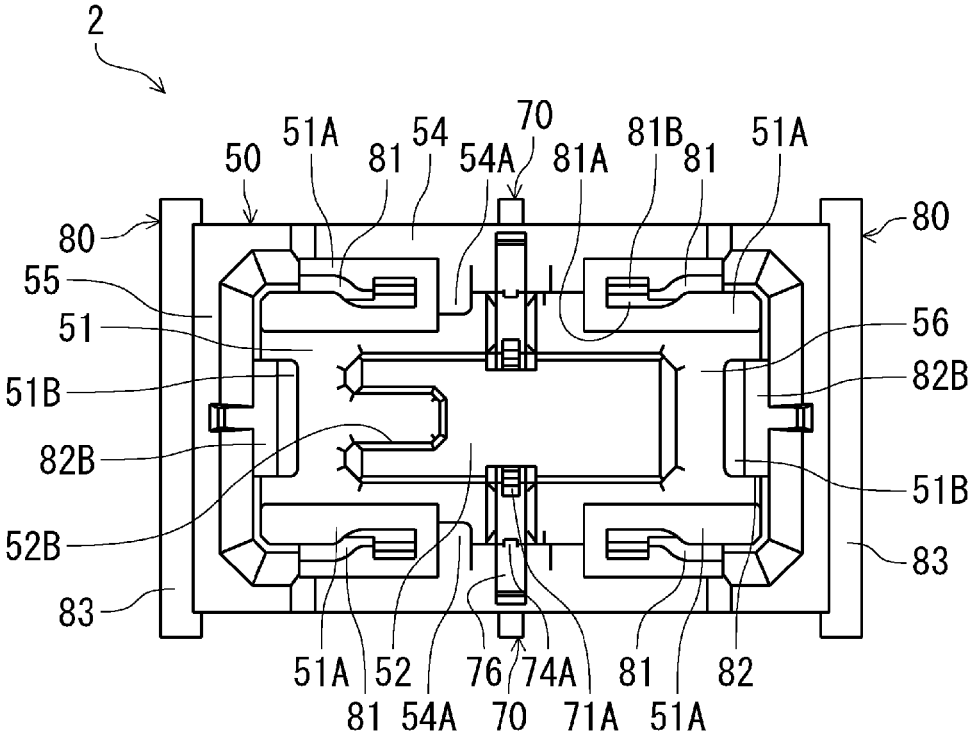
FIG. 3(B) is a top view of the receptacle connector of the electrical connector assembled component according to the embodiment of the invention.

FIG. 1(A) is a perspective view of a plug connector and a receptacle connector according to an embodiment of the invention in a state before fitting the connectors, and FIG. 1(B) is a perspective view of the plug connector shown in FIG. 1(A) that is vertically flipped. FIG. 2 is a partially cutaway perspective view of a plug housing of the plug connector and a receptacle housing of the receptacle connector of FIG. 1(A). FIG. 3(A) is a bottom view of the plug connector of FIG. 1(A) (i.e., a top view of the plug connector of FIG. 1(B)), and FIG. 3(B) is a top view of the receptacle connector of FIG. 1(A).

A plug connector 1 and a receptacle connector 2 of the embodiment are circuit board connectors for disposing on mounting surfaces of separate circuit boards (not shown) and compose an electrical connector assembled component with an insertion/removal direction is a direction perpendicular to a mounting surface of each circuit board (an up-and-down direction in FIG. 1(A)).

As shown in FIGS. 1(A) and 1(B), the plug connector 1 includes a plug housing 10 having a generally rectangular parallelepiped outer shape; and a plurality of terminals 20 held in the plug housing 10. The plurality of terminals 20 is integrally molded in the plug housing 10 to be held therein, with a contact section of each terminal 20 is arranged in a direction parallel to a mounting surface of the circuit board. The plurality of terminals 20 includes a pair of signal terminals 30 held at center positions of the plug housing 10 in an arrangement direction of the contact sections; and end section-side terminals 40 as a pair of power source terminals (herein after referred to as "power source terminals 40") that are held in the direction at end section sides of the plug housing 10 and have different shapes from the signal terminals 30.

First, mainly referring to FIGS. 1(A) and (B), the plug housing 10 will be described. The plug housing 10 is made of an electrically insulating material such as resin, and extends, with an arrangement direction of the contact sections of the terminals 20 is a longitudinal direction. The plug housing 10 has a bottom wall 11 (see FIG. 1(A)) that is horizontal to the mounting surface; and a frame-like circumferential wall 12 that is provided upright (extends downward in FIG. 1(A)) from a circumferential part of the bottom wall 11 as shown in FIG. 1(B).

In the embodiment of the present invention, the circumferential wall 12 is formed as a fitting section to insert in a receptacle-side receiving space 56 of a receptacle connector 2, which will be described later, upon insertion of the connector. The circumferential wall 12 has a pair of side walls that extend in the arrangement direction and a pair of end walls 14 that extend in a connector width direction that is perpendicular to the arrangement direction and join end sections of the pair of side walls 13 together.

As shown in FIG. 1(B), on respective outer surfaces of the pair of side walls 13, there are formed grooves to be guided 13A that extend in an up-and-down direction at positions between a signal terminal 30 and a power source terminal 40 in the arrangement directions. Each groove to be guided 13A receives a thin guide protrusion 54A of the receptacle connector 2, which will be described later, in the connector fitting process and is guided by the thin guide protrusion 54A in the arrangement direction and the connector width direction.

In addition, respective outer surfaces of the pair of end walls 14 have depressed sections 14A in middle positions in the connector width direction, and a plug end plate section 44 of a power source terminal 40, which will be described later, is provided within each depressed section 14A. Moreover, in the spaces formed inside of the depressed sections 14A, spaces 14A-1 (see also FIGS. 6(A) and 6(B)) located between the end walls 14 and the plug end plate sections 44 in the arrangement direction are formed as spaces to allow elastic displacement in the plate thickness direction of the plug end plate sections 44 in the connector fitting process, which will be described later.

As shown in FIG. 1(B), a space that is surrounded by the circumferential wall 12 and is opened upward is formed as a plug-side receiving space 15 to receive a protruding wall section 52 provided like an island in the receptacle connector 2, which will be described later. In addition, as shown in FIG. 1(B), the plug housing 10 has wall sections to be guided 16 that extend upright from the bottom wall 11 within the plug-side receiving space 15, at a position near the end wall 14 having one of the power source terminals 40 in the arrangement direction and a center position in the connector width direction (see also FIG. 3(A) and FIGS. 5(A)-5(B) and 6(A)-6(B)).

In the embodiment, the wall sections to be guided 16 are joined to one end walls 14 in the arrangement direction, with a wall thickness is the connector width direction. The wall sections to be guided 16 enter inside of guide grooves 52B of the receptacle connector 2, which will be described later, from thereabove so as to be guided by the guide groove 52B in the arrangement direction and the connector direction.

Figure 4A:
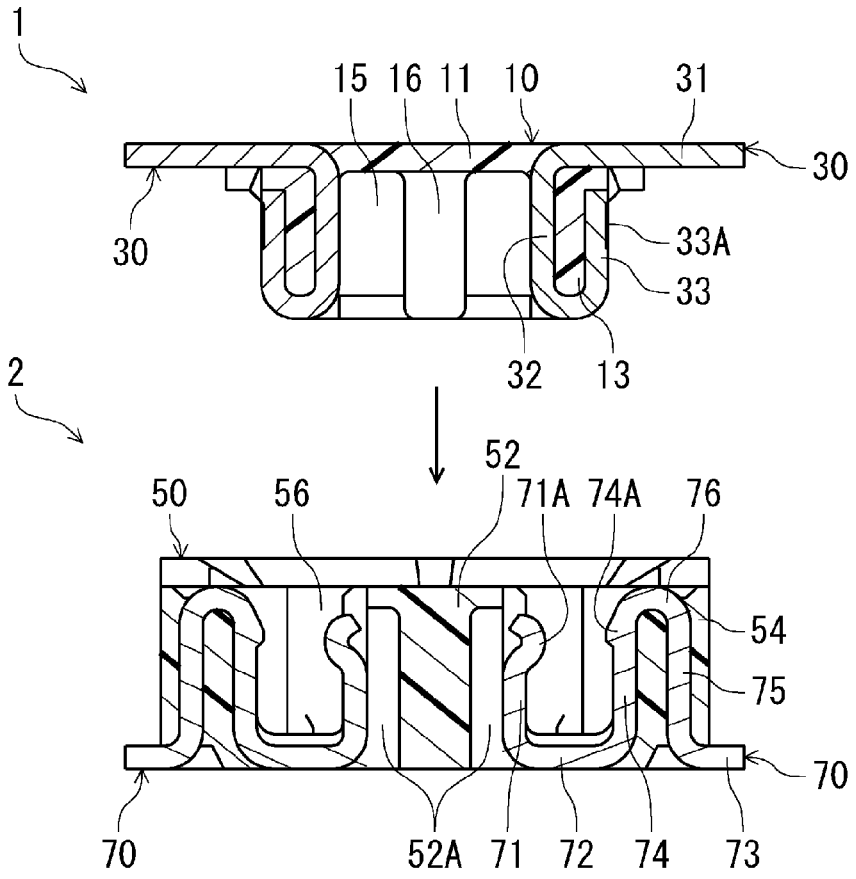
Figure 4B:
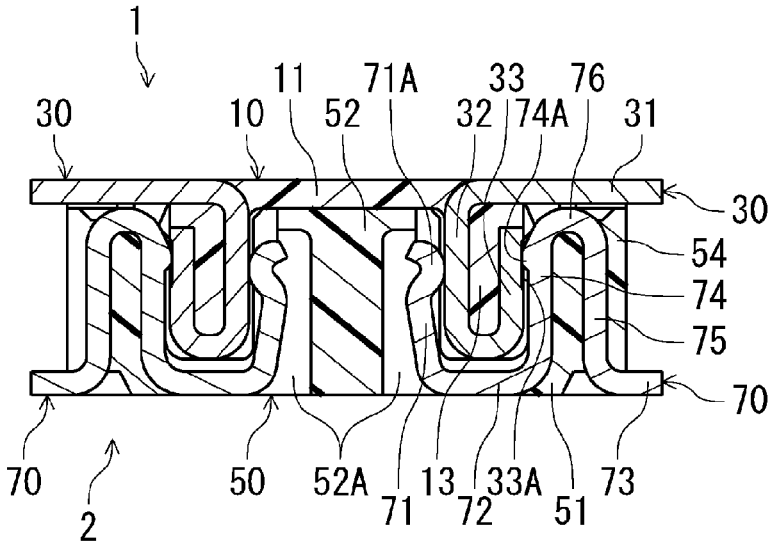

Next, among the plurality of terminals 20, first, the signal terminals 30 will be described mainly with reference to FIG. 1(A) and FIGS. 4(A) and 4(B). FIGS. 4(A) and 4(B) are sectional views of the plug connector 1 and the receptacle connector 2 of FIG. 1(A), which is taken along a surface perpendicular to an arrangement direction of contact sections of the terminals 20 at a position of the signal terminals 30 in the arrangement direction. More specifically, FIG. 4(A)

shows a state before fitting the connectors and FIG. 4(B) shows a state after fitting the connectors.

As shown in FIG. 1(A), the signal terminals 30 are held by integral molding with respective side walls 13 of the plug housing 10 at center positions of the plug housing 10 in the arrangement direction. Each signal terminal 30 is formed by bending a strip-like piece, which is obtained by punching sheet metal, in a plate thickness direction, and as shown in FIGS. 4(A) and 4(B), has a straight connecting section 31 that extends outward from a side wall 13 in the connector width direction (a left-and-right direction in FIGS. 4(A) and 4(B)) at almost the same surface level as that of the bottom wall 11 of the plug housing 10; and a U-shaped section that continues from the connecting section 31, is bent downward in FIGS. 4(A) and 4(B), bent back to a U-shape and embedded in the side wall 13 so to be held therein. The U-shaped section extends along the side wall 13, and a U-shaped plate surface is exposed so as to form a surface at the same surface level as that of the side wall 13.

In the embodiment of the present invention, the connecting sections 31 are configured to connect to signal circuit part of a corresponding circuit board by soldering. In addition, in two leg sections of the U-shaped sections of the signal terminals 30, one leg section provided on the inner wall side of the side wall 13 (on the plug-side receiving space's 15 side) is formed as a contact section 32 to contact with a mating signal terminal 70 of the receptacle connector 2, which will be described later. Each signal contact section 32 is configured to contact with a corresponding signal contact section 71A of the mating signal terminal 70 at a flat plate surface exposed on the inner surface side of the side wall 13. Moreover, the other leg section provided on the outer surface of the side wall 13 is formed as a locking section 33 to engage onto a protrusion to be locked 74A of the mating signal terminal 70. The locking section 33 has a locking recess 33A, a dent on a plate surface for receiving the protrusion to be locked 74A by, for example, by press work.

Next, with reference to FIGS. 1(A)-1(B) through 3(A)-3(B), the power source terminals 40 will be described. Each power source terminals 40 is made as one member by bending sheet metal, and as shown in FIG. 1(A), is held by integral molding with the side walls 13 and the end wall 14 at an end section side portion of the circumferential wall 12 of the plug housing 10 in the arrangement direction.

As shown in FIG. 1(B), each power source terminal 40 has a basal section 41 that extends along an upper surface (a lower surface in FIG. 1(A)) of the end section side portion of the plug housing 10; a plug side plate sections 42 that are bent from the basal section 41 and extends along respective outer surfaces of both side walls 13 of the plug housing 10; connecting sections 43 that are bent at lower ends of the plug side plate sections 42 and extend outward in the respective connector width directions; and a plug end plate section 44 that is bent from the basal section 41 and extends along an outer end surface of the end wall 14 of the plug housing 10.

As shown in FIG. 1(B), in the basal section 41 of each power source terminal 40, a flat upper surface of the basal section 41 is exposed, being at the same surface level as upper surfaces of the side wall 13 and the end walls 14 in area except corners of the end section side portion of the plug housing 10. On the other hand, in the plug side plate sections 42, a flat plate surface of each plug side plate section 42 is exposed, being at the same surface level as an outer surface of the side wall 13, and serves as a contact section to contact with a corresponding contact section 81A of a mating power source terminal 80 provided in the receptacle connector 2, which will be described later.

Next, each connecting section 43 of the power source terminals 40 is provided at almost the same height level as that of the bottom wall 11 of the plug housing 10 (see FIGS. 1(A) and 2), and is designed to connect with a power source circuit part of corresponding circuit board (not shown) by soldering. In addition, as well shown in FIG. 1(B), a bent portion where the plug side plate section 42 and the connecting section 43 are joined is covered with a part of the plug housing 10. Moreover, the plug end plate section 44 of each power source terminal 40 is held within the depressed section 14A of the end wall 14 of the plug housing 10, by integral molding of both edge sections, which extend in the up-and-down direction, with the plug housing 10.

In addition, on a plate surface of each plug end plate section 44, there is formed a step-like locking section 44A that protrudes outward in the arrangement direction and has a step-like shape, for example by press work. Each step-like locking section 44A is configured to be able to engage the step-like section to be locked 82B-1 of the mating power source terminal 80 in the connector removal direction.

Next, the receptacle connector 2 will be described. As shown in FIG. 1(A), the receptacle connector 2 includes a receptacle housing 50 that generally has a rectangular parallelepiped outer shape; and a plurality of mating terminals 60 held in the receptacle housing 50. The plurality of mating terminals 60 is held by integral molding in the receptacle housing 50 such that corresponding contact sections of the respective mating terminals 60 are arranged in one direction that is parallel to a mounting surface of a circuit board. The plurality of mating terminals 60 includes a pair of mating signal terminals 70 held at center positions of the receptacle housing 50 in the arrangement direction of the corresponding contact sections; and end section-side mating terminals 80, which is a pair of power source terminals held at the end section sides of the receptacle housing 50 in the direction and have different shapes from that of the mating signal terminals 70 (hereinafter referred to as "mating power source terminals 80").

In the embodiment of the present invention, the receptacle housing 2 is made of an electrically insulating material such as resin, with a longitudinal direction is an arrangement direction of corresponding contact sections of the mating terminals 60. The receptacle housing 50 includes a bottom wall 51 that is parallel to the mounting surface (see FIG. 2); a protruding wall section 52 that extends upright from a circumferential part of the bottom wall 51 and extends in the arrangement direction; and a frame-like circumferential wall 53 that extends upright from the bottom wall 51 and surrounds the protruding wall section 52.

In the embodiment of the present invention, the circumferential wall 53 includes a pair of side walls 54 that extend in the arrangement direction; a pair of end walls 55 that extend in a connector width direction that is perpendicular to the arrangement direction and join end sections of the pair of side walls 54. Between the protruding wall section 52 and the circumferential wall 53, an annular space that is opened upward is formed as a receptacle-side receiving space 56 to receive the circumferential wall 12 as a fitting section of the plug connector 1.

Figure 5A:
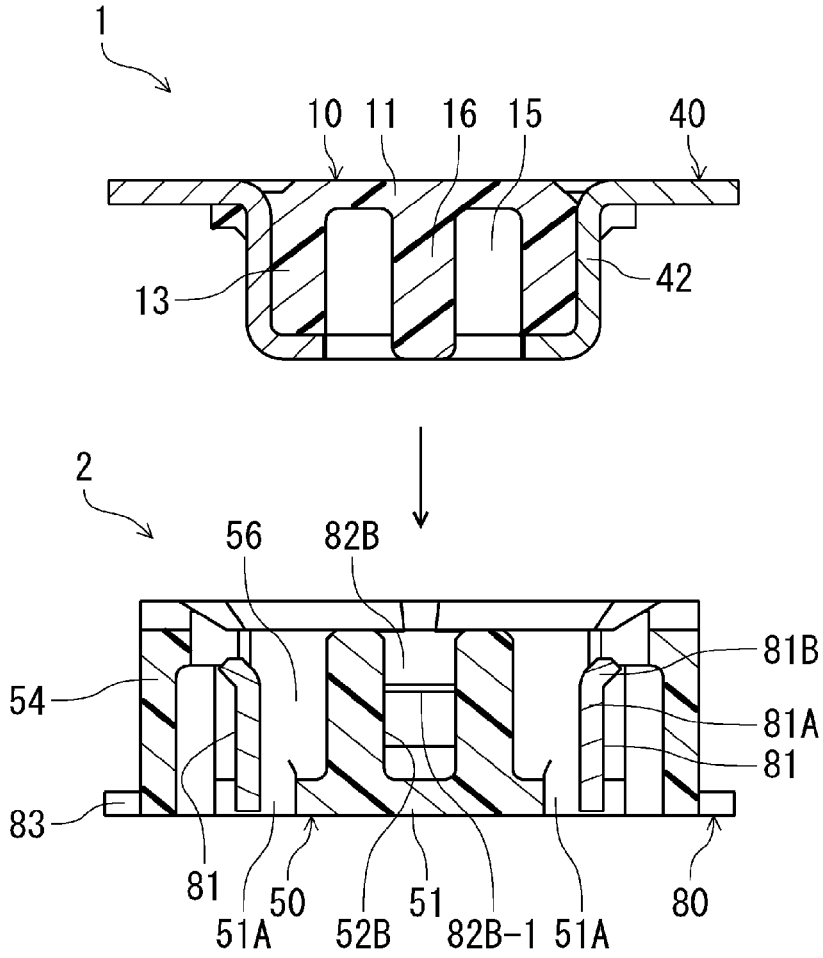

As well shown in FIG. 3(B), the bottom wall 51 has holes 51A that penetrate the bottom 51 at four corners thereof (see also FIGS. 5(A) and (B)). As shown in FIG. 3(B), the holes 51A are formed in a range that contains receptacle side plate sections 81 of the mating power source terminals 80, which will be described later, when viewed in a direction perpendicular to the paper surface. The holes 51A are intended for enabling insertion of a die upon integral molding of the receptacle housing 50 with the mating power source terminals 80. More specifically, by performing integral molding while a die that is formed to surround the receptacle side plate sections 81 shown in FIG. 3(B) from three sides thereof is inserted through the holes 51A, a space is formed, which allows elastic displacement of the receptacle side plate sections 81 in the connector width direction (in an up-and-down direction in FIG. 3(B)).

Figure 6A:
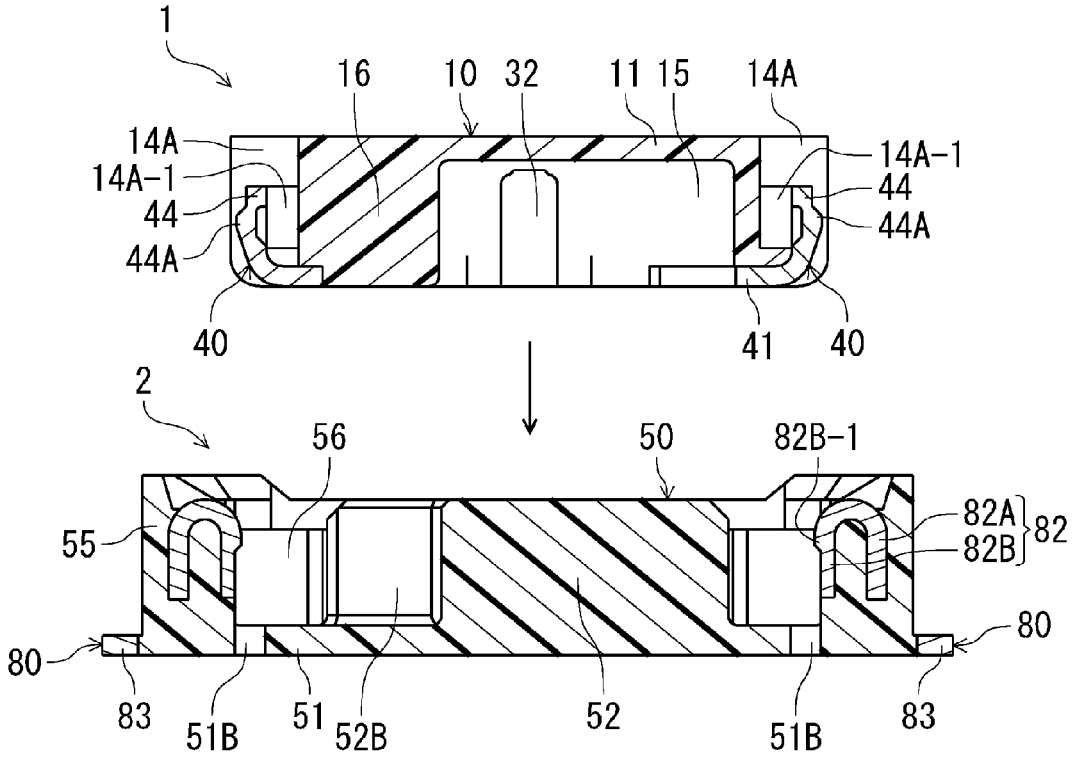

In addition, as well shown in FIG. 3(B), at center positions in the connector width direction (an up-and-down direction in FIG. 3(B)), the bottom wall 51 has holes 51B that penetrates the bottom wall 51 in a direction perpendicular to the paper surface, being adjacent to the end walls 55 in the arrangement direction (in a left-and-right direction in FIG. 3(B)) (see also FIGS. 6(A) and (B)). As shown in FIG. 3(B), each hole 51B is formed in a range that contains a plate section to be locked 82B of the mating power source terminal 80, which will be described later, when viewed in a direction perpendicular to the paper surface.

Similarly to the holes 51A, the holes 51B are also holes to enable insertion of the die upon integral molding of the receptacle housing 50 with the mating power source terminals 80. More specifically, by performing integral molding while the die (not shown) having a shape so as to cover the step-like sections to be locked 82B-1 of the plate sections to be locked 82B (see FIGS. 6(A) and (B)) from thereunder is inserted from thereunder through the holes 51B, a space is formed under the step-like section to be locked 82B-1 so as to have the step-like sections to be locked 82B-1 protrude from the end walls 55 in the arrangement direction.

As shown in FIG. 1(A), FIG. 2, and FIGS. 4(A) and 4(B), in the protruding wall section 52 provided like an island on the bottom wall 51 has elastic displacement allowing grooves 52A that provide spaces to allow elastic displacement of the elastic arms 71 of the mating signal terminals 70, which will be described later, being dented on both side surfaces and extending in the up-and-down direction.

Figure 6B:
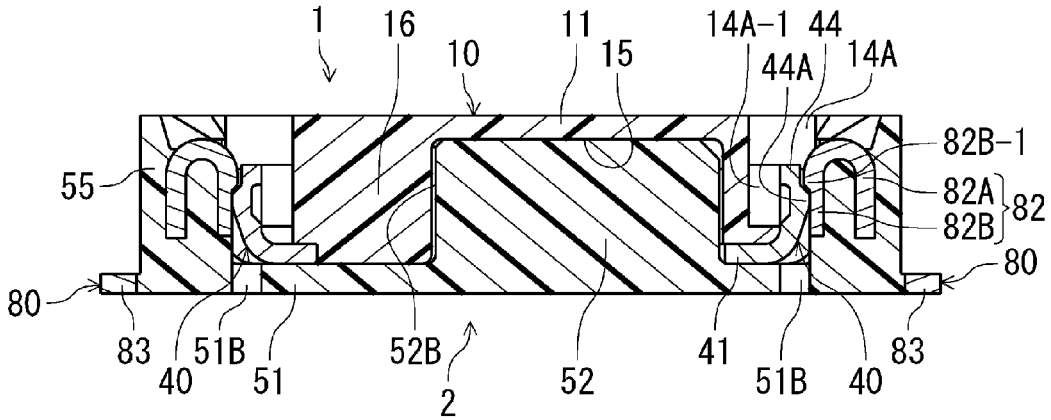

As shown in FIGS. 1(A) and 3(B), each end surface (a surface perpendicular to the connector width direction) that faces one end wall 55 has a guide groove 52B to guide the wall section to be guided 16 of the plug connector 52, which is formed being dented on the end surface and extending in the up-and-down direction (see also FIGS. 6(A) and 6(B)).

As shown in FIG. 1(A) and FIGS. 3(A) and (B), on an inner surface (a surface on the receptacle-side receiving space 56 side) of each side wall 54 of the receptacle housing 50, there is formed a thin guide protrusion 54A, which protrudes towards the receptacle-side receiving space 56 and extends in the up-and-down direction, at a position corresponding to that of the groove to be guide 13A of the side wall 13 of the plug connector 1.

Therefore, according to the embodiment, the plug housing 10 has the section to be guided 16 and the grooves to be guided 13A, whereas the receptacle housing 50 has the guide groove 52B and the thin guide protrusions 54A. Accordingly, it is possible to prevent wrong insertion, fitting the connectors in a wrong direction relative to each other in the arrangement direction.

Next, in the plurality of mating terminals 60, mainly with reference to FIG. 1(A) and FIGS. 4(A) and (B), the mating signal terminals 70 will be first described. Each mating signal terminal 70 is made bending a strip piece obtained by punching sheet metal, and as shown in FIGS. 4(A) and (B), it generally has a 90-degree rotated S-shape when viewed in the arrangement direction. Each mating signal terminal 70 has an inverse U-shape section to be embedded in and held by integral molding with the side wall 54 of the receptacle housing 50; an elastic arm section 71 that extends in an up-and-down direction along the protruding wall section 52; a lower joining section 72 to be embedded and held by integral molding with the bottom wall 51 and to join lower ends of an inner leg section 74 of the inverse U-shaped section, which will be described later, and the elastic arm section 71; and a signal connecting section 73 that extends outside the housing from a lower end of an outer leg section 75 of the inverse U-shape section, which will be described later.

In the embodiment of the present invention, the inverse U-shaped section includes two leg sections that extend in the up-and-down direction, i.e. the inner leg section 74 provided on the inner side in the connector width direction and an outer leg section 75 provided on the outer side in the direction; and an upper joining section 76 that joins upper ends of the inner leg section 74 and the outer leg section 75. The inner leg section 74 extends in the up-and-down direction along the inner surface of the side wall 54 and is exposed, such that a plate surface on the receptacle-side receiving space is at the same surface level as that of the inner surface of the side wall 54.

In addition, at a position close to an upper end of each inner leg section 74, the protrusion to be locked 74A that protrudes towards the receptacle-side receiving space 56 is formed, for example by press work. On the other hand, each outer leg section 75 extends in the up-and-down direction inside the side wall 54. Moreover, each upper joining section 76 is exposed, such that an upper surface thereof is at the height level as that of the side wall 54.

In the embodiment of the present invention, the elastic arm 71 is configured to be able to elastically displace in the connector width direction (in a left-and-right direction in FIGS. 4(A) and 4(B)), such that an upper end, a free end, has a corresponding signal contact section 71A that is formed being curved to protrude to the receptacle-side receiving space side. The lower joining section 72 extends in the connector width direction along the bottom wall 51 and is exposed such that an upper surface of the lower joining section 72 is at the same surface level as that of an upper surface of the bottom wall 51.

In the embodiment of the present invention, the signal connecting section 73 is provided at almost the same height level as that of the bottom surface of the receptacle housing 50, and is connected to a signal circuit part of a corresponding circuit board (not shown) by soldering.

Next, the mating power source terminals 80 will be described mainly with reference to FIGS. 1(A)-1(B) through 3(A)-3(B). Each mating power source terminal 80 is formed as one member by bending sheet metal, and as shown in FIG. 1(A), is held by integral molding with the end wall 55 at an end section-side portion of the receptacle housing 50 in the arrangement direction. As can be understood from FIGS. 2 and 3(A)-3(B), each mating power source terminal 80 includes the receptacle side plate sections 81 that respectively extend along both side walls 54 of the receptacle housing 50; a receptacle end plate section 82 that extends along the end wall 55 of the receptacle housing 50 and join the two receptacle side plate sections 81; and connecting sections 83 that extend in the connector width direction and are joined at a lower end of the receptacle end plate sections 82.

As well shown in FIG. 2, each receptacle side plate section 81 has a shape of a cantilever that extends inward (on the mating signal terminal 70 side) in the arrangement direction. As well shown in FIG. 3(B), the receptacle side plate section 81 is provided at two positions that face to each other in the width direction between inner surfaces of the side walls 54 of the receptacle housing 50, with a gap therebetween in the connector width direction (in an up-and-down direction in FIG. 3(B)). Within a range of the gap, each receptacle side plate section can elastically displace outward in the connector width direction (on the side wall 54 side) in the plate thickness direction.

As shown in FIG. 3(B), each receptacle side plate section 81 is bent to generally form a crank-shape when viewed from thereabove, such that a portion on the free end side is provided inward in the connector width direction relative to other parts. The portion on the free end side is provided inside the receptacle-side receiving space 56 and is formed as a corresponding contact section 81A that contacts at a plate surface thereof with the plug side plate section 42 that is a contact section of the power source terminal of the plug connector 1.

Figure 5B:
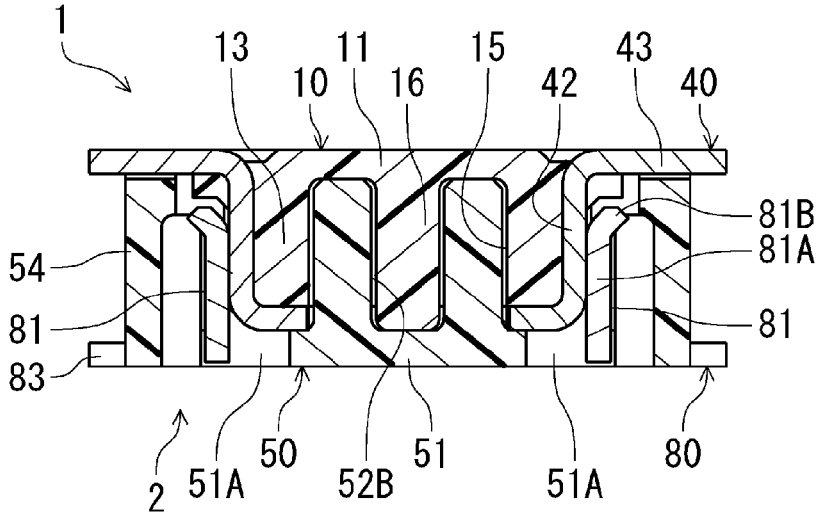

As well shown in FIGS. 1(A) and 2, an upper end of each corresponding contact section 81A is slightly tilted outward in the connector width direction and each tilted section is formed as a tilted section 81B to guide the power source terminal 40 of the plug connector 1 to the position to contact with the corresponding contact section 81A (see also FIGS. 5(A) and 5(B)).

According to the embodiment, as described above, the receptacle side plate section 81 having the corresponding contact section 81A can elastically displace in the connector width direction. Therefore, in the connector fitting state, each plug side plate section 42 that serves as a contact section of the power source terminal 40 and each corresponding contact section 81A of the mating power source terminal 80 elastically contact to each other with sufficient contact pressure in the plate thickness direction (connector width direction), so that it is possible to more securely stabilize the state of contact between the plug side plate section 42 and the corresponding contact section 81A. In addition, the plug side plate section 42 and the corresponding contact section 81A contact by surface in wide area at each flat plate surface, it is possible to secure the satisfactory contact state.

As described above, according to the embodiment, each plug side plate section 42 and the corresponding contact section 81A are configured to contact by surface at their flat plate surfaces, but the plate surfaces of the plug side plate section and the corresponding contact section do not have to be flat surfaces as long as it is possible to secure sufficient contact area. For example, it is possible to configure such that one of the plug side plate section and the corresponding contact section has a contact protrusion that is curved in the plate thickness direction so as to protrude in the connector width direction and thereby have the contact protrusion, and the contact protrusion contacts with the other flat plate surface, of the other, i.e. the corresponding contact section or the plug side plate section.

Furthermore, according to the embodiment, each mating power source terminal of the receptacle connector has a portion that can elastically displace and a corresponding contact section is formed thereon, but it is also possible to provide a portion that can elastically displace in each power source terminal of the plug connector and form a contact section thereon.

As shown in FIG. 2, each receptacle end plate section 82 includes a main body plate section 82A that extends in the connector width direction and joins the two receptacle-side plate sections 81; and the plate section to be locked 82B that extends and fold back with an upper edge thereof of the main plate section 82A downward (see also FIGS. 6(A) and 6(B)). Each receptacle end plate section 82 is embedded in the end wall 55 of the receptacle housing 50 in a state that a plate surface of the plate section to be locked 82B is exposed towards the receptacle-side receiving space 56 (see also FIGS. 6(A) and 6(B)).

Each plate section to be locked 82B has a step-like section to be locked 82B-1, which is formed like steps in the up-and-down direction in the whole area in the connector width direction, for example, by press work, and can engage the step-like locking section 44A of the power source terminal 40 of the plug connector 1 in the connector removal direction. Moreover, each connecting section 83 extends in the connector width direction at a position of an end section in the arrangement direction at almost the same height level as that of the bottom surface of the receptacle housing 50, and is configured to connect to a power source circuit part of a corresponding circuit board (not shown) by soldering.

Next, referring to FIG. 1(A) and FIGS. 4(A)-4(B), 5(A)-5(B), and 6(A)-6(B), connector fitting process will be described. FIGS. 5(A) and 5(B) are sectional views taken along a surface perpendicular to an arrangement direction of contact sections of terminals at a position of contact sections of power source terminals in the arrangement direction. More specifically, FIG. 5(A) shows a state before fitting the connectors and FIG. 5(B) shows a state of fitting the connectors; and FIGS. 6(A) and 6(B) are sectional views taken along a surface perpendicular to a connector width direction of contact sections of terminals at a position of locking sections of power source terminals in the connector width direction. More specifically, FIG. 6(A) shows a state before fitting the connectors and FIG. 6(B) shows a state of fitting the connectors.

First, attach and then connect the plug connector 1 and the receptacle connector 2 to respective corresponding circuit boards (not shown) by soldering. Then, as shown in FIG. 1(A), FIG. 4(A), FIG. 5(A), and FIG. 6(A), in a state right before fitting the connectors, orientate the receptacle connector 2 such that the receptacle-side receiving space 56 directs upward, and orientate the plug-side receiving space 15 of the plug connector 1 so as to direct the plug-side receiving space 15 downward above the receptacle connector 2.

Next, while keeping the orientation shown in FIGS. 1(A), 4(A), 5(A), and 6(A), move the plug connector 1 downward so as to put the circumferential wall 12 of the plug connector 1 into the receptacle-side receiving space 56 of the receptacle connector 2 from thereabove and relatively move the protruding wall section 52 of the receptacle connector 2 into the plug-side receiving space 15 of the plug connector 1. At this time, with movement of the wall sections to be guided 16 of the plug housing 10 from thereabove into the guide grooves 52B from thereabove and movement of the thin guide protrusions 54A of the receptacle housing 50 in the grooves to be guided 13A of the plug housing 13A, the plug connector 1 is guided in the connector width direction and the arrangement direction of the contact sections of the terminals 20.

As a result, as shown in FIG. 4(B), the U-shaped portion of each signal terminals 30 of the plug connector 1 moves to open up between the corresponding signal contact sections 71A of the mating signal terminals 70 of the receptacle connector 2 and the protrusion to be locked 74A. Then, in the connector fitted state, the elastic arm section 71 of each mating signal terminal 70 elastically displace towards inside of the elastic displacement allowing groove 52A of the protruding wall section 52, and thereby the corresponding signal contact section 71A contacts by its surface with the contact section 32 of the signal terminal 30 with certain contact pressure. In addition, the protrusion to be locked 74A of each mating signal terminal 70 moves into the locking concave section 33A of the signal terminals 30 to a position so as to be able to engage in the connector removal direction (upward). With this movement, the signal terminals electrically contact to each other and lock in the connector removal direction (upward).

In addition, as shown in FIG. 5(B), each plug side plate section 42 of the power source terminals 40 of the plug connector 1 moves to open up between the two receptacle side plate sections 81 of the mating power source terminals 80 of the receptacle connector 2. Then, in this connector fitting state, the receptacle side plate sections 81 elastically displace towards the side walls 54 of the receptacle housing 50 and the corresponding contact sections 81A of the receptacle side plate sections 81 contact with the plug side plate sections 42 with certain contact pressure.

Therefore, the power source terminals 40 are in a state of being tightly pressed with the two corresponding contact sections 81A of the mating power source terminals 80 at positions of the plug side plate sections 42. As a result, the contact pressure between the plug side plate sections 42 and the corresponding contact sections 81A increases, and it is possible to stabilize the contact state.

In addition, when the step-like locking sections 44A touches the step-like sections to be locked 82 of the power source terminals 80, the plug end plate sections 44 of the power source terminals 40 elastically displace towards the space 14A-1 side of the end walls 14 of the plug housing 10, and once the step-like locking sections 44A cross the step-like section to be locked 82B-1 of the plate sections to be locked 82B, it moves back to the released state. Then, in the connector fitting state, as shown in FIG. 6(B), the step-like locking section 44A is below the step-like sections to be locked 82B-1. As a result, the step-like locking sections 44A and the step-like sections to be locked 82B-1 are positioned to be able to engage in the connector removal direction, which causes locking in the direction.

According to the embodiment, in the power source terminals 40 of the plug connector 1 and the mating power source terminals 80 of the receptacle connector 2, there are provided the step-like locking sections 44A and the step-like sections to be locked 82B-1 on the plug end plate section 44 and the receptacle end plate section 82, respectively. In other words, the step-like locking sections 44A are provided separately from the plug side plate sections 42, which are provided as contact sections, whereas the step-like sections to be locked 82B-1 are provided separately from the receptacle side plate sections 81 that have corresponding contact sections 81A formed thereon.

Therefore, according to the embodiment, each plug side plate section 42, which serves as a contact section, and the corresponding contact section 81A do not have to have a step-like section for engaging in the connector insertion/removal direction. Accordingly, even when the connector assembled component receives unexpected external force in the connector removal direction, the contact sections and the corresponding contact sections 81A will not engage to each other. As a result, each plug side plate section 42, which serves as the contact section, and the corresponding contact section 81A of the receptacle connector 2 do not receive engaging force against the external force, and the contact state will not be unstable. As described above, according to the embodiment, the locking sections and the sections to be locked can lock to each other with sufficient locking force, and it is possible to secure the stable contact state between the plug side plate sections 42 and the corresponding contact sections 81A.

In addition, according to the embodiment, the step-like locking sections 44A of the power source terminals 40 and the step-like sections to be locked 82B-1 of the mating power source terminals 80 are not respectively provided on the side wall sides of the plug housing 1 and the receptacle housing 2, but on the end wall sides. If the step-like locking sections and the step-like sections to be locked are provided on the side wall sides, it is necessary to provide the step-like locking sections and the step-like sections to be locked respectively on the side plate sections of the respective power source terminals, but since the side plate sections serve as contact sections, there is limitation in the width dimension (a dimension in the arrangement direction) upon designing, and it may not be possible to have a large width in some cases.

For this reason, as in the embodiment, providing the step-like locking sections and the step-like sections to be locked on the end plate sections, which are electrically separated therefrom, it is possible to form the step-like locking sections and the step-like sections to be locked so as to have large dimensions in the connector width direction. As a result, it is possible to lock the connectors with large engaging force.

According to the embodiment, the plug end plate sections 44 of the power source terminals 40, on which the step-like locking sections 44A are formed, can elastically displace in the plate thickness direction towards the spaces 14A-1 formed in the end walls 55 of the plug housing 10. Therefore, in the connector fitting state, the plug end plate sections 44 and the plate locking sections to be locked 82 of the receptacle connector 2 elastically connect to each other with sufficient contact pressure in the plate thickness direction. As a result, the step-like locking section 44A and the step-like section to be locked 82B-1 engage to each other in the connector removal direction with sufficient degree of interference, it is possible to more securely lock the step-like locking section 44A and the step-like section to be locked 82B-1 together.

In addition, according to the embodiment, the plug end plate sections 44 can elastically displace and the plate sections to be locked 82 of the receptacle connector 2 do not elastically displace, but instead, it is also possible to configure such that the plate sections to be locked 82 of the receptacle connector 2 can elastically displace. In this case, it is necessary to form a space to allow the elastic displacement of the plate sections to be locked 82 on the end walls 55 of the receptacle housing 50. In addition, if it is possible to secure enough interference between the step-like locking sections 44A and the step-like sections to be locked 82B-1, the plug end plate section 44 and the step-like section to be locked 82 do not have to specifically be able to elastically displace.

According to the embodiment, in the plug housing 1, there is formed the plug-side receiving space 15 to receive the island-like protruding wall 52 of the receptacle housing 2, but instead, when the receptacle housing does not have the protruding wall section, it is not necessary to form the receiving space in the plug housing.

According to the embodiment, each terminal 20 of the plug connector 1 and each mating terminal 60 of the receptacle connector 2 are supported by integral molding with the plug housing 10 or the receptacle housing 50, but the form of holding the terminals and the mating terminals may not be limited to this manner. For example, the terminals or the mating terminals may be held being pressed in the press-in holding grooves respectively formed in the plug housing and the receptacle housing.

According to the embodiment, the end section side terminals of each connector are used as power source terminals, but the end section side terminals do not have to be power source terminals. For example, it is also possible to use those terminals as ground terminals. In addition, according to the embodiment, each connector has only a pair of signal terminals, but each connector can have any number of signal terminals and can have a plurality of pairs. Furthermore, according to the invention, each connector has signal terminals in addition to the end section side terminals (power source terminals in the embodiment), but does not have to have signal terminals.

For example, without having signal terminals, each connector can have only end section side terminals. In addition, even when each connector has both end section side terminals and signal terminals, it is also possible to use only end section terminal without using the signal terminals.

The disclosure of Japanese Patent Application No. 2012-104787, filed on May 1, 2012 is incorporated in the application by reference.

While the invention has been explained with reference to the specific embodiments of the invention, the explanation is illustrative and the invention is limited only by the appended claims.

What is claimed is:

1. An electrical connector assembled component, comprising:

a plug connector to be mounted on a first circuit board; and a receptacle connector to be mounted on a second circuit board for connecting to the plug connector, wherein said receptacle connector includes a plurality of mating terminals having receptacle contact portions and a receptacle housing that holds the mating terminals along a side direction, said receptacle housing includes a pair of side walls extending in the side direction, a pair of edge walls extending in an edge direction perpendicular to the side direction for connecting the side walls, and a receptacle space surrounded with the side walls and the edge walls for receiving the plug connector, said plug connector includes a plurality of terminals having plug contact portions that contact with the receptacle contact portions and a plug housing that holds the terminals along the side direction, said plug housing includes a fitting portion that is fitted into the receptacle space, said terminals include an edge terminal disposed on one end portion of the fitting portion in the side direction, said edge terminal includes a plug side plate portion extending in the side direction, a plug edge plate portion extending in the edge direction, and a locking portion formed on the plug edge plate portion, said mating terminals include an edge mating terminal disposed on one end portion of the receptacle housing in the side direction, and said edge mating terminal includes a receptacle side plate portion extending in the side direction, a receptacle edge plate portion extending in the edge direction, and a locked portion formed on the receptacle edge plate portion for engaging with the locking portion.

2. The electrical connector assembled component according to claim 1, wherein said edge terminal includes a pair of plug side plate portions extending on both sides of the plug housing so that the plug edge plate portion connects the plug side plate portions, and said edge mating terminal includes a pair of receptacle side plate portions extending on both sides of the receptacle housing so that the receptacle edge plate portion connects the receptacle side plate portions.

3. The electrical connector assembled component according to claim 1, wherein at least one of said locking portion and said locked portion is configured to be deformable in the edge direction.

4. The electrical connector assembled component according to claim 1, wherein at least one of said plug contact portion and said receptacle contact portion is configured to be deformable in the edge direction.

5. A plug connector to be mounted on a circuit board for connecting a receptacle connector, comprising:

a plurality of terminals having plug contact portions that contact with receptacle contact portions of mating terminals of the receptacle connector; and a plug housing that holds the terminals along a side direction, wherein said plug housing includes a fitting portion that is fitted into a receptacle space of the receptacle connector, said terminals include an edge terminal disposed on one end portion of the fitting portion in the side direction, and said edge terminal includes a plug side plate portion extending in the side direction, a plug edge plate portion extending in an edge direction perpendicular to the side direction, and a locking portion formed on the plug edge plate portion for engaging with a locked portion of one of the mating terminals.

6. The plug connector according to claim 5, wherein said edge terminal includes a pair of plug side plate portions extending on both sides of the plug housing so that the plug edge plate portion connects the plug side plate portions.

7. A receptacle connector to be mounted on a circuit board for connecting to a plug connector, comprising:

a plurality of mating terminals having receptacle contact portions that contact with plug contact portions of terminals of the plug connector; and a receptacle housing that holds the mating terminals along a side direction, wherein said receptacle housing includes a pair of side walls extending in the side direction, a pair of edge walls extending in an edge direction perpendicular to the side direction for connecting the side walls, and a receptacle space surrounded with the side walls and the edge walls for receiving the plug connector, said mating terminals include an edge mating terminal disposed on one end portion of the receptacle housing in the side direction, and said edge mating terminal includes a receptacle side plate portion extending in the side direction, a receptacle edge plate portion extending in the edge direction, and a locked portion formed on the receptacle edge plate portion for engaging with a locking portion of one of the terminals.

8. The receptacle connector according to claim 7, wherein said edge mating terminal includes a pair of receptacle side plate portions extending on both sides of the receptacle housing so that the receptacle edge plate portion connects the receptacle side plate portions.

* * * * *